United States Patent [19]

Stahl et al.

[11] 4,326,639

[45] Apr. 27, 1982

[54] SCREW CAP FOR BOTTLE-TYPE CONTAINERS

[75] Inventors: Otto Stahl, Finnentrop; Horst Schulz, Hanover, both of Fed. Rep. of Germany

[73] Assignees: Georg Menshen & Co. KG, Finnentrop; Riedel-de Haen Aktiengesellschaft, Hanover, both of Fed. Rep. of Germany

[21] Appl. No.: 130,071

[22] Filed: Mar. 13, 1980

[30] Foreign Application Priority Data

Mar. 15, 1979 [DE] Fed. Rep. of Germany ..... 2910178

[51] Int. Cl.[3] ..... B65D 55/12

[52] U.S. Cl. ..... 215/252

[58] Field of Search ..... 215/252, 258

[56] References Cited

U.S. PATENT DOCUMENTS

| | | | |
|---|---|---|---|
| 3,463,341 | 8/1969 | Fields | 215/252 |
| 3,747,793 | 7/1973 | Wassilieff . | |
| 4,062,466 | 12/1977 | Conti | 215/252 |

FOREIGN PATENT DOCUMENTS

| | | | |
|---|---|---|---|
| 2243220 | 3/1974 | Fed. Rep. of Germany | 215/252 |
| 2704461 | 10/1978 | Fed. Rep. of Germany . | |
| 1436645 | 3/1966 | France | 215/252 |
| 2173757 | 10/1973 | France . | |
| 6409078 | 2/1965 | Netherlands | 215/252 |

*Primary Examiner*—Herbert F. Ross

*Attorney, Agent, or Firm*—Curtis, Morris & Safford

[57] ABSTRACT

A screw cap which can be screwed onto the thread of a bottleneck is provided with an outward-projecting collar joined to the cap via shearable links, said shearable links having different flexibility are arranged and formed in such a way that the shearable links of one group can be sheared off only after an angular torsion of the cap relative to the collar which is several times greater than that required for shearing the links of the other group.

18 Claims, 4 Drawing Figures

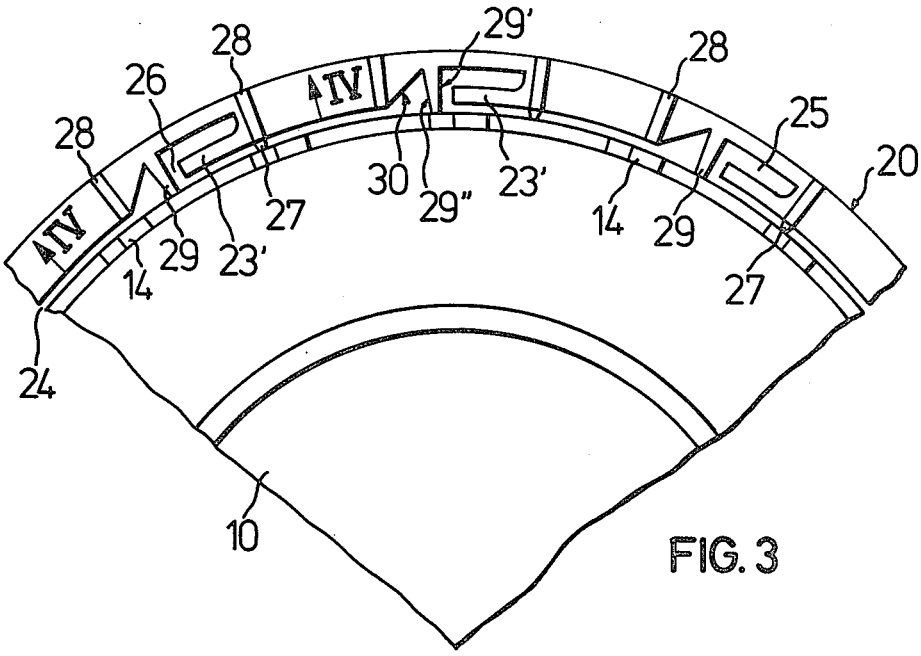
FIG. 3
FIG. 4
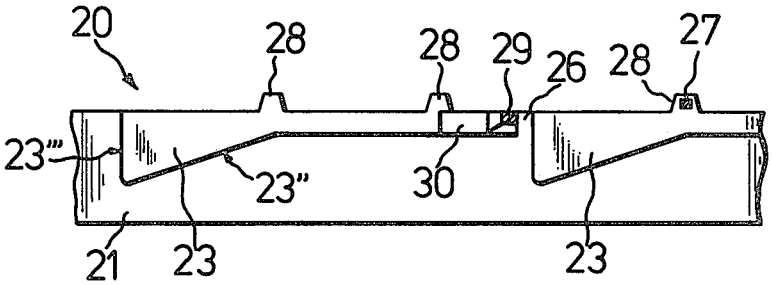

SCREW CAP FOR BOTTLE-TYPE CONTAINERS

The invention relates to a screw cap which is intended for bottle-type containers and which can be screwed onto the thread of the neck of the container and has an outward-projecting collar which is joined to the cap via shearable links.

A tamper-proof screw cap is known in which the collar and the cap are joined to one another by a plurality of short, substantially stiff-elastic shearable webs which tear off simultaneously when, under the action of a certain adequate torque to be applied manually on the cap, a relative angular torsion of a few degrees occurs between the cap and the collar (compare German patent specification No. 2,243,220). The dimensions of the shearable links must here be such that, on the one hand, they are detached from the cap with a reasonable application of force but, on the other hand, they must provide a sufficiently stable joint between the cap and the collar so that premature shearing of the links is avoided during the manufacture of the closures, during their transport and when they are screwed onto the container, which as a rule is carried out by a machine. As a result, in order to achieve sufficiently stable bonding of the collar to the cap, for example, by providing a sufficiently large number of shearable links, or to bond over an enlarged surface, the force to be applied manually for shearing the shearable links was excessive for problem-free handling of the closures. If the bonding was less stable, however, the result was a relatively high rate of screw cap rejects in which the collar and the cap had already prematurely separated. The difficulties described become more serious as the the nominal diameter of the cap increases, so that tamper-proof screw caps of the described construction have only gained acceptance for caps of relatively small standard dimensions, despite their advantages in production engineering.

Therefore, it is the object of the invention to provide a screw closure in which the bonding of the collar to the cap is reliable and stable and the necessary force required for shearing the bonding positions is kept within reasonable limits.

The invention relates to a screw cap for bottle-type containers, which consists of a cap which can be screwed onto the thread of a bottleneck, an outward-projecting collar extending along the outer circumference of the cap, which collar is joined to the cap via a plurality of shearable links distributed over the circumference, a plurality of blocking teeth being resiliently molded to the collar along the circumference thereof, which blocking teeth engage with stop teeth located on the bottleneck in such a way that the screwed-on cap can be removed from the bottleneck only if the shearable links are sheared off, and which comprises the shearable links (27, 29) being sub-divided into at least two groups of different flexibility and being arranged and formed in such a way that the shearable links (29) of the second group can be sheared off only after an angular torsion of the cap (10) relative to the collar (20), which is several times greater than that required for shearing the shearable links (27) of the first group.

According to the invention, the shearable links are, as distinct from the known design, sub-divided into several, preferably two, groups of different flexibility. The shearable links of the second group are arranged, relative to the shearable links of the first group, and formed in such a way that, under a certain torque acting on the cap, initially only the shearable links of the first group tear off and severing of the shearable links of the second group then takes place under the further action of a torque of equal or approximately equal magnitude. The relative angular torsion between the cap and the collar, required for severing the shearable links of the second group, is here several times, in general about two to three times, greater than the angular torsion, by which the shearable links of the first group are detached from the cap. This is advantageous because there may be a large number of shearable links joining the collar to the cap and hence reliable bonding of the collar and the force required for detaching the cap from the collar can be as low as about 50% of that which would otherwise be necessary with an equal number of identical shearable links. The screw cap according to the invention thus meets, in an outstanding manner, both the demands of the user with respect to trouble-free handling and the demands for a stable joint between the collar and the cap. Also premature severing of the two parts during the working steps mentioned at the outset is prevented. In particular, in the case of screw closures having large nominal dimensions, there are, as a result of the measures according to the invention, no longer any restrictions with respect to the number of bonding positions to be provided between the collar and the cap. A further improvement, compared with the known design, is that a pressure-absorbing segment is provided on the top of the collar at least in the zone of each shearable link of the first group, which segment prevents the collar from being bent under the lower end of the cap in the case of an external pressure load. Such pressure loads, occurring during the transport of the screw closures in boxes or during the manufacture of the screw closures by the injection-molding process, can be of a magnitude which deforms the collar such that the latter is prematurely detached from the cap.

Particular embodiments of the invention are characterized by the following features:

(a) The shearable links of the first group extend over a relatively short free length and the shearable links of the second group extend, between the collar and the outer circumference of the cap, over a free length which is several times greater than that of the shearable links of the first group.

(b) Each shearable link of the second group is associated with an oblique surface which is formed in the collar and which limits the deformation of the shearable link during the angular torsion of the cap, relative to the collar, in the direction of unscrewing. In this case, it is a particular advantage when each shearable link of the second group has a conical shape adapted to the angle of inclination of the oblique surface.

(c) As viewed in the direction of screwing on the cap, one shearable link of the first group is provided in each case close to the run-up end of each resilient blocking tooth and one shearable link of the second group is provided in each case to the run-off end of each blocking tooth.

(d) Along the circumference of the collar, resilient tongues are formed, to which one downward-projecting blocking tooth is molded in each case, the collar and the tongues being located in a common plane which extends substantially perpendicular to the center axis of the cap, and the oblique surface here is essentially an extension in the direction of unscrewing, of the edge facing away from the cap, of a cut-out which is provided in the collar and forms the resilient tongues, and a shearable link of the second group projecting in the direction of the cap is molded on at each transition from the edge to the oblique surface.

(e) The bonding positions of the shearable links of the first group to the cap substantially are spots and the bonding positions of the shearable webs of the second group to the cap are two-dimensional.

(f) A pressure-absorbing segment is molded to the top of the collar at least in the zone of each shearable link of the first group, which segment prevents the collar from being bent under the lower end of the cap in the case of an external pressure load.

In the following text, an embodiment of the invention is explained in more detail by reference to the drawing in which:

FIG. 3 shows a partial plan view of the screw cap according to FIG. 1; and FIG. 4 shows a detail view of the collar, seen along line IV—IV in FIG. 3.

Figure 1:
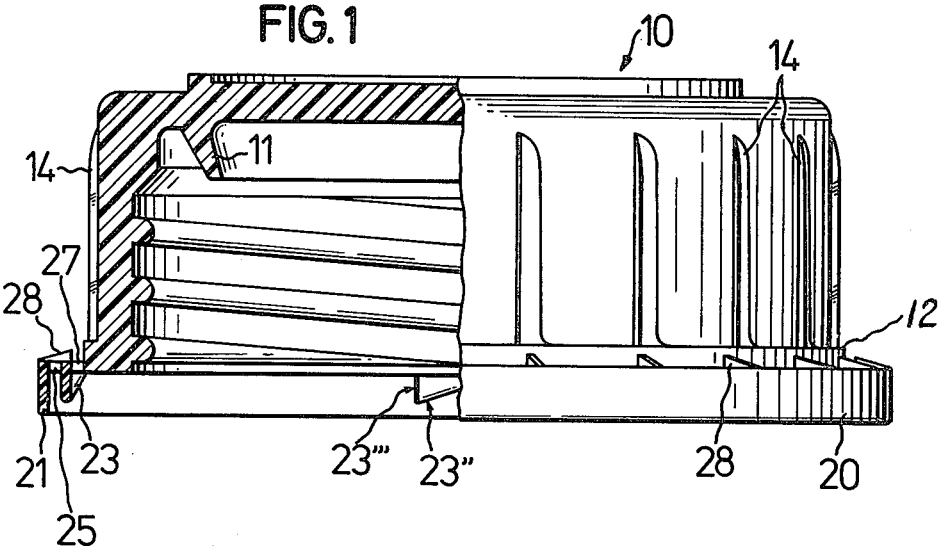
FIG. 1 shows a overall view, partially in section, of a screw cap according to the invention.
Figure 2:
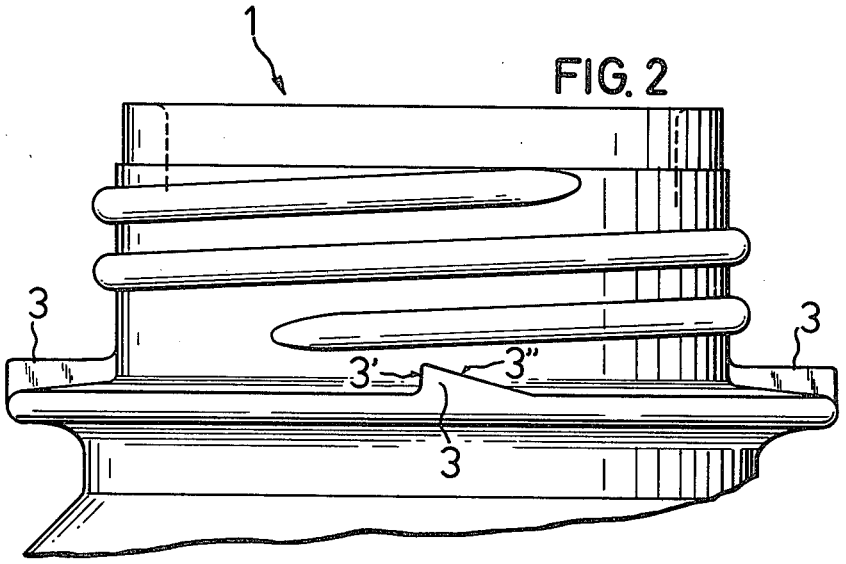
FIG. 2 shows a partial view of the neck of a bottle suitable for the screw cap according to the FIG. 1.

According to FIG. 1, the screw cap according to the invention comprises a cap generally marked 10. A sealing cone 11, which can engage and seal the mouth opening of the neck of a bottle 1 (shown in FIG. 2), is molded to the inner surface of the upper horizontal end wall of the cap 10, concentrically to the longitudinal center axis of the cap. The cap edge 12 extends along the outer periphery of the end wall substantially vertically downward with an internal thread 15 which is formed in its inner surface and which corresponds to an external thread on the neck of the bottle 1. At the same mutual angular spacing, vertically extending gripping ribs 14 are formed along the outer circumferential surface of the cap edge 12, which ribs are intended to make it easier to screw the cap 10 on and off the neck of the bottle 1.

At a distance from and along the outer lower circumference of the cap edge 12, a collar 20 extends substantially horizontally, or perpendicular to the longitudinal center axis of the cap 10, and a downward-projecting annular band 21 is molded to the outer circumferential edge of the collar. The annular band 21 is molded to collar 20 and covers blocking teeth 23 so that they cannot be manipulated from the outside. Preferably, according to FIG. 3, the blocking teeth 23 are molded onto resilient tongues 23' and extend downwards from the latter, parallel to and at a distance from the annular band 21, so that the blocking teeth 23 can carry out an up-and-down movement. The resilient tongues 23' are preferably located in the plane of the horizontal collar 20 and are formed by essentially an L-shaped cut-out formed by two cut-outs 25, 26 in the collar 20. The longer cut-out 25 here extends parallel to and at a suitable distance from the outer circumference of the cap edge 12, the shorter cut-out 26 is located perpendicular to the cut-out 25 and extends in the direction of the outer circumference of the cap edge 12.

To each resilient tongue 23', formed in this way, a blocking tooth 23 shown in FIGS. 1 and 4 is molded, which, as viewed in the direction of screwing on the cap 10, has an oblique run-up surface 23'' which is adjoined by a vertical run-off surface or blocking surface 23'''.

Moreover, the collar 20 is joined via a plurality of shearable links 27, 29 in a circumferentially distributed arrangement to the outer circumferential surface of the cap edge 12, the shearable links 27, 29 bridging the annular gap 24 between the collar 20 and the cap edge 12 and having such dimensions that, under certain different relative torsions between the collar 20 and the cap 10, they tear off the latter.

According to the invention, the shearable links are here sub-divided into at least two groups. The shearable links 27 of the first group preferably have the shape of a truncated cone and have a length which essentially corresponds only to the width of the annular gap 24, and they are approximately spot-bonded to the outer circumference of the cap edge 12. Due to the short length over which the shearable links 27 of the first group extend, their deformability in the direction of unscrewing of the cap 10 is restricted to such an extent that they already tear off under a relatively slight relative angular torsion between the cap 10 and the collar 20.

As can be seen particularly from FIG. 3, however, the shearable links 29 of the second group extend over such a length between their molding points on the collar 20 and the outer circumferential surface of the cap edge 12 that, due to the greater deformability resulting from this, they can follow a relative torsion between the collar 20 and the cap 10, without tearing and with lateral yielding, over a larger angle zone than the shearable links 27. Only after the said angle zone has been exceeded, the shearable links 29 of the second group also tear off their bonding positions on the cap edge 12 so that the cap 10 is now finally released from the collar 20.

The severing of the collar 20 from the cap 10 thus takes place, according to the invention, in at least two steps since, under the action of an initial torque on the cap, only the short shearable links 27 of the first group tear off initially and, under the further action of the torque, the shearable links 29 of the second group are subsequently also severed from the cap. Preferably, the shearable links 29 here have such dimensions that the torque required for them to shear off is approximately equal to or only insignificantly greater than the torque which causes the shearable links 27 of the first group to shear off. In spite of the large number of shearable links which are to be provided for a reliable joint between the collar 20 and the cap 10, in particular in the case of screw closures having a large diameter, and which prevent premature severing of the collar from the cap during transport and while the screw closures are screwed on by machine, the necessary force to be applied for shearing off in general amounts to only 50% of that which, with the same number, would otherwise be necessary for simultaneously shearing off all the shearable links.

Each shearable link 29 of the second group preferably has a shape which conically tapers in the direction of the cap edge 12, at least one lateral edge 29'' of the shearable link having an oblique course, whereas the opposite, lateral edge 29' can extend perpendicular to the cap edge 12. The angle of inclination of the oblique lateral edge 29'' is preferably matched to the angle of inclination of an oblique surface 30 formed in the collar 20 in such a way that, at a certain angular torsion of the cap 10 relative to the collar 20, the shearable link 29 makes substantially flush contact with the oblique surface 30. The oblique surface 30 thus restricts the travel, within which each shearable link 29 can be laterally deformed or bent off, without tearing off the cap edge 12.

In the preferred embodiment of the invention as shown, having blocking teeth 23 molded to resilient tongues 23', each oblique surface 30 preferably represents an imaginary extension in the direction of unscrewing, of that outer edge of the cut-out 25 extending in the circumferential direction which faces away from the cap edge 12 and which ends on the inner circumferential edge of the collar 20. The shearable link 29 is here molded to the transition from the said edge to the oblique surface 30 so that it is located at a small distance in front of the free end of the particular resilient tongue 23'. Instead of this arrangement of the oblique surface 30 and the shearable link 29 in the collar 20, it is also possible to provide separate appropriately shaped, preferably trapezoidal recesses, if either the blocking teeth 23 can, due to inherent resilience, be molded directly onto the collar 20 or if it is desired to provide the shearable links 29 of the second group in positions on the collar 20, which differ from those described and shown.

According to FIG. 3, the shearable links 27 of the first group on the collar 20 are also formed close to the resilient tongues 23' or blocking teeth 23, preferably at a point before the start of the run-up surfaces 23'' of the blocking teeth; however, they can also be located in other positions on the collar 20. In any case, however, the distribution of the shearable links 27 of the first group and that of the shearable links 29 of the second group along the circumference of the collar 20 should be such that there is always one shearable link 29 of the second group between an adjacent pair of shearable links 27 of the first group.

For example, in a cap having a nominal diameter of 80 mm, twelve shearable links 29 of the second group and twelve shearable links 27 of the first group can be provided at a suitable angular spacing along the circumference of the collar 20. The angular torsion, required for shearing off the shearable links 27 of the first group, of the cap 10 relative to the collar 20 can here, for example, be 5°, whilst an angular torsion of, for example, 10° to 15° is necessary for shearing off the shearable links 29 of the second group. The oblique surface 30 can here be located at an angle of about 45° relative to a vertical plane which extends through the center point of the cap and parallel to one vertical lateral edge 29' of the particular shearable link 29.

Furthermore, according to the invention, at least the shearable links 27 of the first group are associated with pressure-absorbing segments 28 which, according to FIG. 4, are molded to the top of the collar 20 and are preferably shaped in the form of a nose and have a trapezoidal cross-section. At their ends facing the cap 10, these pressure-absorbing segments 28 form abutment surfaces which come into contact with the outer surface of the cap when, for example during the transport of the screw closures or during the ejection of the closures from the injection mold, lateral pressure forces act on the collar 20, which forces, without the provision of the pressure-absorbing segments 28, would sometimes have the result that the collar moves underneath the free end of the cap edge 12, and the collar 20 is thus prematurely severed from the cap 10. Preferably, pressure-absorbing segments 28 of this type are provided not only in the zone of the shearable links 27 of the first group, but also in intermediate positions on the collar 20. Moreover, the pressure-absorbing segments 28 effect a stiffening of the collar 20 against bending in the direction of the longitudinal center axis of the screw closure.

In use, the screw cap according to the invention is screwed, manually or by machine, onto the neck of a bottle-type container, preferably a wide-necked bottle. During the screwing-on movement, the blocking teeth 23 on the collar 20 eventually come into contact with the correspondingly shaped stop teeth 3 which are formed on the neck of the container and which, like the blocking teeth 23, are provided with run-up surfaces 3'' and vertical stop surfaces 3'. During screwing-on, the run-up surfaces 23'' of the blocking teeth 23 can therefore slide over the run-up surfaces 3'' of the stop teeth 3, the blocking teeth 23 thus yielding upwards due to their resilient molding to the collar 20. If, in the state of engagement between the teeth 23 and 3, the cap is turned in the opposite direction, that is to say in the direction of unscrewing, the vertical stop surfaces 23' of the blocking teeth 23 come into engagement with the vertical stop surfaces 3' of the stop teeth 3 and thus prevent further torsion of the cap 10 in the direction of unscrewing. Only when a certain torque is exceeded, the shearable links 27 of the first group, which join the thus fixed collar 20 to the cap 10, are sheared off and then, after a further angular torsion of the cap 10, the shearable links 29 of the second group are likewise sheared off, whereupon the cap 10 can be fully unscrewed from the neck of the bottle 1.

The screw cap according to the invention preferably consists of a thermoplastic, for example polyethylene, and it can be manufactured in one piece in an economical manner by the injection-molding process.

We claim:

1. A screw cap comprising a cap, the inside of which is threaded and adapted to be screwed on a threaded neck of a container;

a collar extending along the outer circumference of the cap and outwardly projecting therefrom;

a plurality of shearable links which join the collar to the cap along the circumference of the cap, said links being distributed along the circumference of the cap and extending radially therefrom to the collar; and a plurality of blocking teeth which are resiliently molded to the collar and which are adapted to engage stop teeth on the neck of said container in such a manner as to shear off said links when said cap is unscrewed from the threaded neck of the container;

said shearable links including first and second groups of shearable links, each of the links of the second group having a free length between the collar and cap which is several times greater than the free length of each of the links of the first group, having a flexibility which differs from the flexibility of each of the links of the first group and requiring, in order to be sheared off between the cap and collar, an angular torsion of the cap relative to the collar which is several times greater than the angular torsion required for the links of the first group to be sheared off between the cap and collar, each shearable link of the second group is associated with an oblique surface which is formed in the collar and which limits the deformation of the shearable link during the angular torsion of the cap, relative to the collar, in the direction of unscrewing.

2. A screw cap as claimed in claim 1, wherein each shearable link of the second group has a conical shape adapted to the angle of inclination of the oblique surface.

3. A screw cap as claimed in claim 1 or 2, wherein said blocking teeth are shaped as to have a run-up end and a run-off end and, as viewed in the direction of screwing on the cap, a shearable link of the first group is provided adjacent to the run-up end of a tooth of the blocking teeth and a shearable link of the second group is provided adjacent to the run-off end of the tooth of the blocking teeth.

4. A screw cap as claimed in claim 3, wherein:

a plurality of resilient tongues are formed in the collar, each of said resilient tongues having a downwardly projecting blocking tooth therein, said tongues and collar being substantially in a plane which extends substantially perpendicular to the center axis of the cap;

the collar is provided with a cutout, which is bounded by a side of the resilient tongue, a first edge between the resilient tongue and the outer circumference of said collar, the oblique surface, and a second edge which forms the outer circumference of the cap, said oblique surface being located at a position in the direction of unscrewing the cap relative to the position of said resilient tongue and being joined at a junction to said first edge; and a link of the second group being attached to said collar at the junction of said oblique surface and first edge and being attached to the cap on the second edge at a point radially inward from the junction of the oblique surface and first edge.

5. A screw cap as claimed in any of claims 1 or 2, wherein the bonding positions of the shearable links of the first group to the cap substantially are spots and the bonding positions of the shearable links of the second group to the cap are two-dimensional.

6. A screw cap as claimed in any of claims 1 or 2, wherein a pressure-absorbing segment is provided in the top of the collar at least in the zone of each shearable link of the first group, said segment preventing the collar from being bent under a lower end of the cap in the case of an external pressure load.

7. The screw cap of claim 1, wherein the shearable links consist of first and second groups of shearable links and each of said links of the second group are equal in length and each of said links of the first group are equal in length.

8. A screw cap comprising:

a cap, the inside of which is threaded and adapted to be screwed on a threaded neck of a container;

a collar extending along the other circumference of the cap and outwardly projecting therefrom;

a plurality of shearable links which join the collar and the cap along the circumference of the cap, said links being distributed along the circumference of the cap and extending therefrom in the direction of the collar and said links including first and second groups of shearable links, each of the links of the second group having a flexibility which differs from the flexibility of each of the links of the first group and requiring, in order to be sheared off between the cap and collar, an angular torsion of the cap relative to the collar which is several times greater than the angular torsion required for the links of the first group to be sheared off between the cap and collar, each shearable link of the second group is associated with an oblique surface which is formed in the collar and which limits the deformation of the shearable link during the angular torsion of the cap, relative to the collar, in the direction of unscrewing; and a plurality of blocking teeth which are resiliently molded to the collar and which are adapted to engage stop teeth on the neck of said container in such a manner as to shear off said links when said cap is unscrewed from the threaded neck of the container, said blocking teeth being shaped as to have a run-up end and a run-off end and, as viewed in the direction of screwing on the cap, a shearable link of the first group is provided adjacent to the run-up end of a tooth of the blocking teeth and a shearable link of the second group is provided adjacent to the run-off end of the tooth of the blocking teeth.

9. A screw cap comprising:

a cap, the inside of which is threaded and adapted to be screwed on a threaded neck of a container;

a collar extending along the outer circumference of the cap and outwardly projecting therefrom;

a plurality of shearable links which join the collar and the cap along the circumference of the cap, said links being distributed along the circumference of the cap and extending therefrom in the direction of the collar, and said links including first and second groups of shearable links, each of the shearable links of the first group joining the cap and collar substantially in a spot and each of the shearable links of the second group joining the cap and collar in a two-dimensional junction, and each of the links of the second group having a flexibility which differs from the flexibility of each of the links of the first group and requiring, in order to be sheared off between the cap and collar only, an angular torsion of the cap relative to the collar which is several times greater than the angular torsion required for the links of the first group to be sheared off between the cap and collar; each shearable link of the second group is associated with an oblique surface which is formed in the collar and which limits the deformation of the shearable link during the angular torsion of the cap, relative to the collar, in the direction of unscrewing; and a plurality of blocking teeth which are resiliently molded to the collar and which are adapted to engage stop teeth on the neck of said container in such a manner as to shear off said links when said cap is unscrewed from the threaded neck of the container.

10. A screw cap comprising:

a cap, the inside of which is threaded and adapted to be screwed on a threaded neck of a container;

a collar extending along the outer circumference of the cap and outwardly projecting therefrom;

a plurality of shearable links which join the collar and the cap along the circumference of the cap, said links being distributed along the circumference of the cap and extending therefrom in the direction of the collar, said shearable links including first and second groups of shearable links, each of the links of the second group having a flexibility which differs from the flexibility of each of the links of the first group, requiring, in order to be sheared off between the cap and collar, an angular torsion of the cap relative to the collar which is several times greater than the angular torsion required for the links of the first group to be sheared off between the cap and collar, and being associated with an oblique surface which is formed in the collar and which limits the deformation of the shearable link during the angular torsion of the cap, relative to the collar, in the direction of unscrewing;

a plurality of blocking teeth which are resiliently molded to the collar and which are adapted to engage stop teeth on the neck of said container in such a manner as to shear off said links when said cap is unscrewed from the threaded neck of the container; and a pressure-absorbing segment provided in the top of the collar at least in the zone of each shearable link of the first group, said segment preventing the collar from being bent under a lower end of the cap in the case of an external pressure load.

11. The screw cap as claimed in claim 8, 9 or 10, wherein each of the links of the second group has a free length between the collar and cap which is several times greater than the free length of each of the links of the first group.

12. The screw cap of claim 11, wherein the shearable links consist of first and second groups of shearable links and each of said links of the second group is equal in length and each of said links of the first group is equal in length.

13. A screw cap as claimed in claim 8 or 9, wherein each shearable link of the second group is associated with an oblique surface which is formed in the collar and which limits the deformation of the shearable link during the angular torsion of the cap, relative to the collar, in the direction of unscrewing.

14. A screw cap as claimed in claim 13, wherein each shearable link of the second group has a conical shape adapted to the angle of inclination of the oblique surface.

15. A screw cap as claimed in claim 10, wherein each shearable link of the second group has a conical shape adapted to the angle of inclination of the oblique surface.

16. A screw cap as claimed in claim 12, wherein:

a plurality of resilient tongues are formed in the collar, each of said resilient tongues having a downwardly projecting blocking tooth therein, said tongues and collar being substantially in a plane which extends substantially perpendicular to the center axis of the cap;

the collar is provided with a cutout, which is bounded by a side of the resilient tongue, a first edge between the resilient tongue and the outer circumference of said collar, an oblique surface, and a second edge which forms the outer circumference of the cap, said oblique surface being associated with each shearable link of the second group, being formed in the collar and limiting the deformation of the shearable link during the angular torsion of the cap, relative to the collar, in the direction of unscrewing, said oblique surface being located at a position in the direction of unscrewing the cap relative to the position of said resilient tongue and being joined to said first edge; and a link of the second group being attached to said collar at the junction of said oblique surface and first edge.

17. A screw cap as claimed in claim 8 or 10, wherein each of the shearable links of the first group join the cap and collar substantially in a spot and each of the shearable links of the second group join the cap and collar in a two-dimensional junction.

18. A screw cap as claimed in claim 8 or 9, wherein a pressure-absorbing segment is provided in the top of the collar at least in the zone of each shearable link of the first group, said segment preventing the collar from being bent under a lower end of the cap in the case of an external pressure load.

* * * * *